US005791200A

United States Patent [19]

Papasideris

[11] Patent Number: 5,791,200

[45] Date of Patent: Aug. 11, 1998

[54] APPARATUS FOR CONTROLLING SPEED OF AN IMPLEMENT

[75] Inventor: Stamos I. Papasideris, Bristol, Ill.

[73] Assignee: Caterpillar Inc., Peoria, Ill.

[21] Appl. No.: 763,274

[22] Filed: Dec. 10, 1996

[51] Int. Cl.[6] ..... G05G 5/05; G05G 5/08

[52] U.S. Cl. ..... 74/529; 74/526; 15/82

[58] Field of Search ..... 74/529, 527, 526; 15/78, 82, 87; 318/663

[56] References Cited

U.S. PATENT DOCUMENTS

| | | | |
|---|---|---|---|
| 3,491,395 | 1/1970 | McCandless | 74/526 X |
| 4,490,874 | 1/1985 | Duncan | 15/87 |
| 4,643,261 | 2/1987 | Long | 15/82 X |
| 4,938,302 | 7/1990 | Schott et al. | 74/529 X |
| 5,062,316 | 11/1991 | Lykken et al. | 74/529 |
| 5,499,553 | 3/1996 | Schott et al. | 74/526 |

*Primary Examiner*—Charles A. Marmor
*Assistant Examiner*—Mary Ann Battista
*Attorney, Agent, or Firm*—Maginot & Addison

[57] ABSTRACT

A position setting apparatus includes a control member and a slave member mechanically coupled to the control member, with the slave member having a plurality of notches defined therein. The apparatus further includes a retainer positionable between a first retainer position and a second retainer position, wherein (1) the retainer is engaged with one of the plurality of notches when the retainer is positioned in the first retainer position, and (2) the retainer is disengaged from all of the plurality of notches when the retainer is positioned in the second retainer position.

17 Claims, 9 Drawing Sheets

| Position | Speed | Direction |
|---|---|---|
| $P_{-2}$ | 2X | Counterclockwise |
| $P_{-1}$ | X | Counterclockwise |
| $P_0$ | 0 | – |
| $P_1$ | X | Clockwise |
| $P_2$ | 2X | Clockwise |

APPARATUS FOR CONTROLLING SPEED OF AN IMPLEMENT

BACKGROUND OF THE INVENTION

The present invention relates generally to control devices for vehicles, and more particularly to an apparatus for controlling the speed of an implement.

Vehicles, such as street sweepers, wheel loaders, and excavators, are typically equipped with a hydraulically powered implement, such as a broom or a grapple. The implement is generally coupled to the vehicle via a boom linkage. In particular, the boom linkage is coupled at a first end to a chassis of the vehicle and at a second end to the implement.

The vehicle typically includes a control device operatively linked to a number of hydraulic components, which an operator may use to control the various movements of the boom linkage and the implement. That is, the control device may include a number of levers each of which controls a different function of the boom linkage or implement. For example, a first lever may be used to raise or lower the boom linkage, a second lever may be used to adjust the tilt of the boom linkage, and a third lever may be used to control a function of the implement. In the case of a street sweeper, the third lever may be used to control a hydraulic motor such that the direction and speed of a rotating broom may be altered.

One drawback to known implement control devices is that the levers included therein are "self-centering". That is, the lever will continue to actuate the component, i.e. a hydraulic valve, so long as the operator continues to apply pressure to the lever, but when the operator releases the lever, the lever returns to a neutral position and ceases to actuate the component. In the case of a street sweeper, the broom will continue to revolve at a given speed and direction so long as the operator holds the third lever at a fixed position other than its neutral position. However, if the operator releases the lever, the lever will return to its neutral position, thereby causing the broom to stop revolving. Hence, if an operator wishes to "lock in" the broom at a given speed and direction, the operator must continue to manually hold the lever at a fixed position.

To overcome this problem, the lever may be held in place with a "bungee" or other type of strap. In particular, the lever may be secured in the desired position, i.e. the desired speed and direction of the broom, by connecting the strap at a first end to the lever and at a second end to a portion of a cab of the vehicle. However, this may be inconvenient for the operator in that the strap will have to be repositioned each time the operator desires to change the position of the lever.

What is needed therefore is an apparatus for controlling speed of an implement that allows the implement to operate at a constant speed without the need for an operator to manually hold a lever in a desired position. What is further needed is an apparatus for controlling speed of an implement which may easily engaged and disengaged.

SUMMARY OF THE INVENTION

According to one embodiment of the present invention, there is provided a position setting apparatus. The apparatus includes a control member and a slave member mechanically coupled to the control member, with the slave member having a plurality of notches defined therein. The apparatus further includes a retainer positionable between a first retainer position and a second retainer position, wherein (1) the retainer is engaged with one of the plurality of notches when the retainer is positioned in the first retainer position, and (2) the retainer is disengaged from all of the plurality of notches when the retainer is positioned in the second position.

According to a second embodiment of the present invention, there is provided an apparatus for controlling speed of an implement. The apparatus includes a first lever movable between a first control position and a second control position. The apparatus further includes a slave member mechanically coupled to the first lever, with the slave member having a plurality of notches defined therein. The apparatus further includes a retainer positionable between a first retainer position and a second retainer position, wherein (1) the retainer is engaged with one of the plurality of notches when the retainer is positioned in the first retainer position, and (2) the retainer is disengaged from all of the plurality of notches when the retainer is positioned in the second retainer position. The implement is moved at a first speed when the first lever is positioned at the first control position, and moved at a second speed when the first lever is positioned at the second control position.

It is therefore an object of the present invention to provide a new and useful position setting apparatus.

It is another object of the present invention to provide an improved position setting apparatus.

It is moreover an object of the present invention to provide a new and useful apparatus for controlling speed of an implement.

It is yet another object of the present invention to provide an improved apparatus for controlling speed of an implement.

It is a further object of the present invention to provide an apparatus for controlling speed of an implement which can be easily engaged and disengaged.

It is yet another object of the present invention to provide an apparatus for controlling speed of an implement which allows the implement to operate at a constant speed without the need for an operator to manually hold a lever in a desired position.

The above and other objects, features, and advantages of the present invention will become apparent from the following description and the attached drawings.

DETAILED DESCRIPTION OF THE PREFERRED EMBODIMENT

Figure 1:
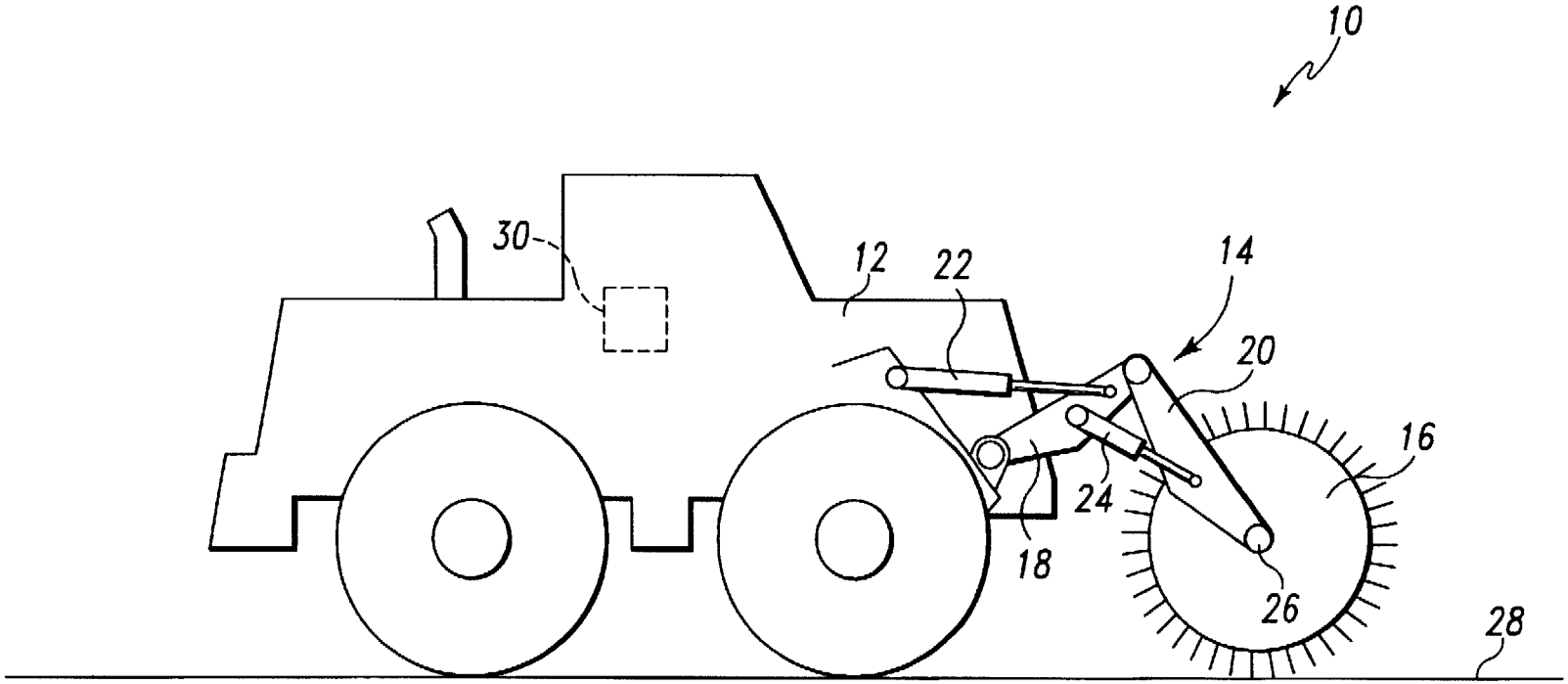
FIG. 1 is a side elevational view of a vehicle which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a vehicle 10, such as a street sweeper. The vehicle 10 includes a body 12, a boom linkage 14, and a broom 16.

The boom linkage 14 includes a lift member 18, a tilt member 20, a lift cylinder 22, and a tilt cylinder 24. The boom linkage 14 couples the broom 16 to the body 12. In particular, a first end of the lift member 18 is pivotally connected to the body 12, whereas a second end of the lift member 18 is pivotally coupled to a first end of the tilt member 20. A second end of the tilt member 20 has the broom 16 rotatably secured thereto. In particular, the broom 16 rotates about an axle 26 which is attached to the second end of the tilt member 20.

The lift cylinder 22 and the tilt cylinder 24 provide the motive power for moving the lift member 18 and the tilt member 20, respectively. More specifically, the lift member 18 may be raised by retracting the lift cylinder 22, and may be lowered by extending the lift cylinder 22. Similarly, the tilt member 20 may be tilted downwardly by retracting the tilt cylinder 24, and may be tilted upwardly by extending the tilt cylinder 24. Hence, by operating the lift cylinder 22 and the tilt cylinder 24, the broom 16 may be moved relative a horizontal surface, such as a street 28.

The vehicle 10 further includes an implement control device 30. The implement control device is operatively linked to the lift cylinder 22, the tilt cylinder 24, and a hydraulic motor 47 which provides the motive power to rotate the broom 16 relative to the street 28. Therefore, an operator of the vehicle 10 may operate the implement control device 30 so as to (1) raise and lower the lift member 18, (2) upwardly and downwardly tilt the tilt member 20, and (3) alter the rotational speed and direction of the broom 16.

Figure 2:
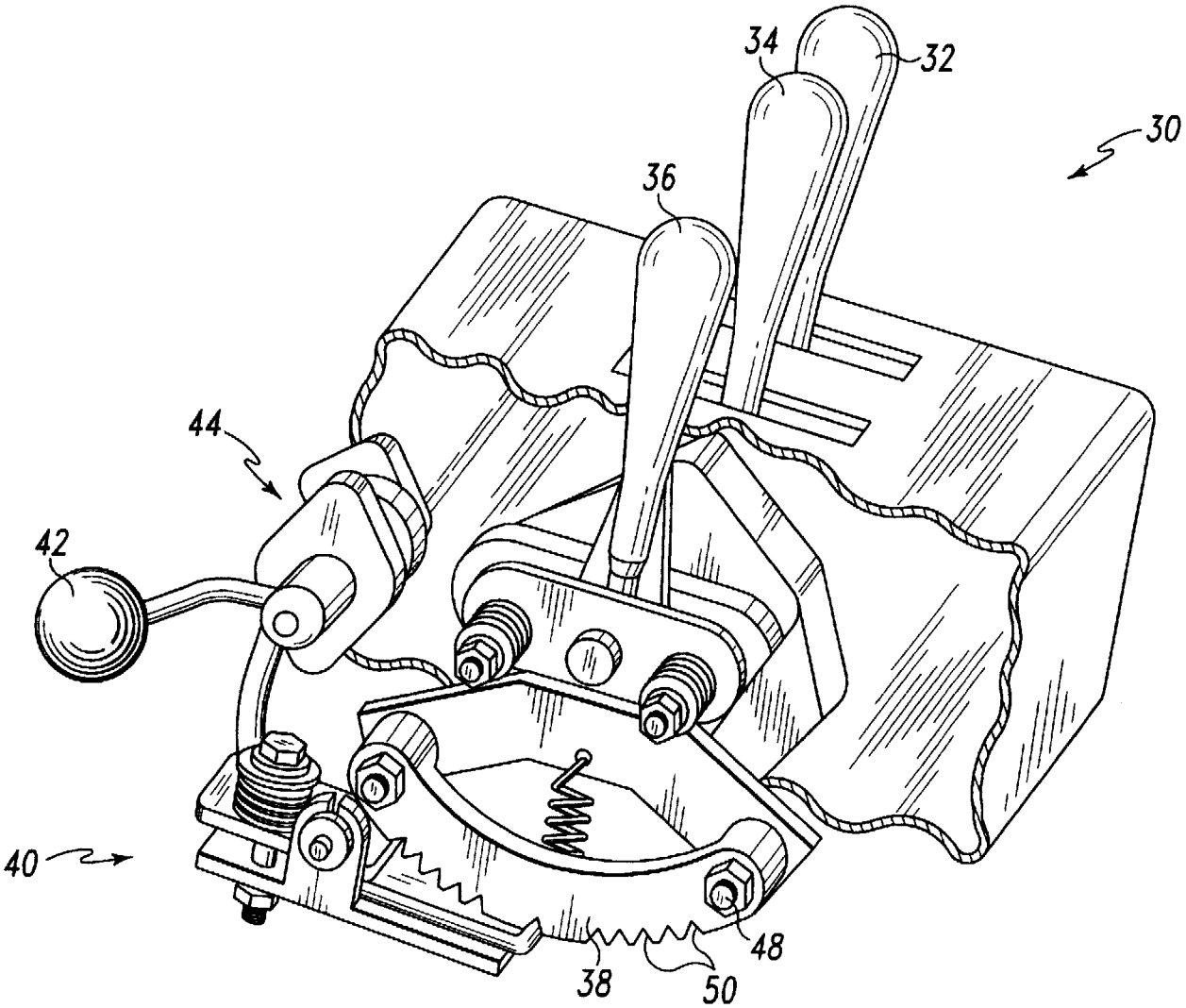
FIG. 2 is a fragmentary perspective view of an implement control device of the vehicle of FIG. 1.

Referring now to FIG. 2, there is shown the implement control device 30. The implement control device 30 includes a lift lever 32, a tilt lever 34, and a control member or broom lever 36. The implement control device 30 further includes a slave member 38, a retainer assembly 40, a disengagement lever 42, and a mechanical disengagement linkage 44.

The lift lever 32 is operatively coupled to the lift cylinder 22 (see FIG. 1), thereby allowing the operator of the vehicle 10 to raise and lower the lift member 18 (see FIG. 1). Similarly, the tilt control lever 34 is operatively coupled to the tilt cylinder 24 (see FIG. 1), thereby allowing the operator of the vehicle 10 to upwardly or downwardly tilt the tilt member 20 (see FIG. 1).

Figures 3A, 3B:
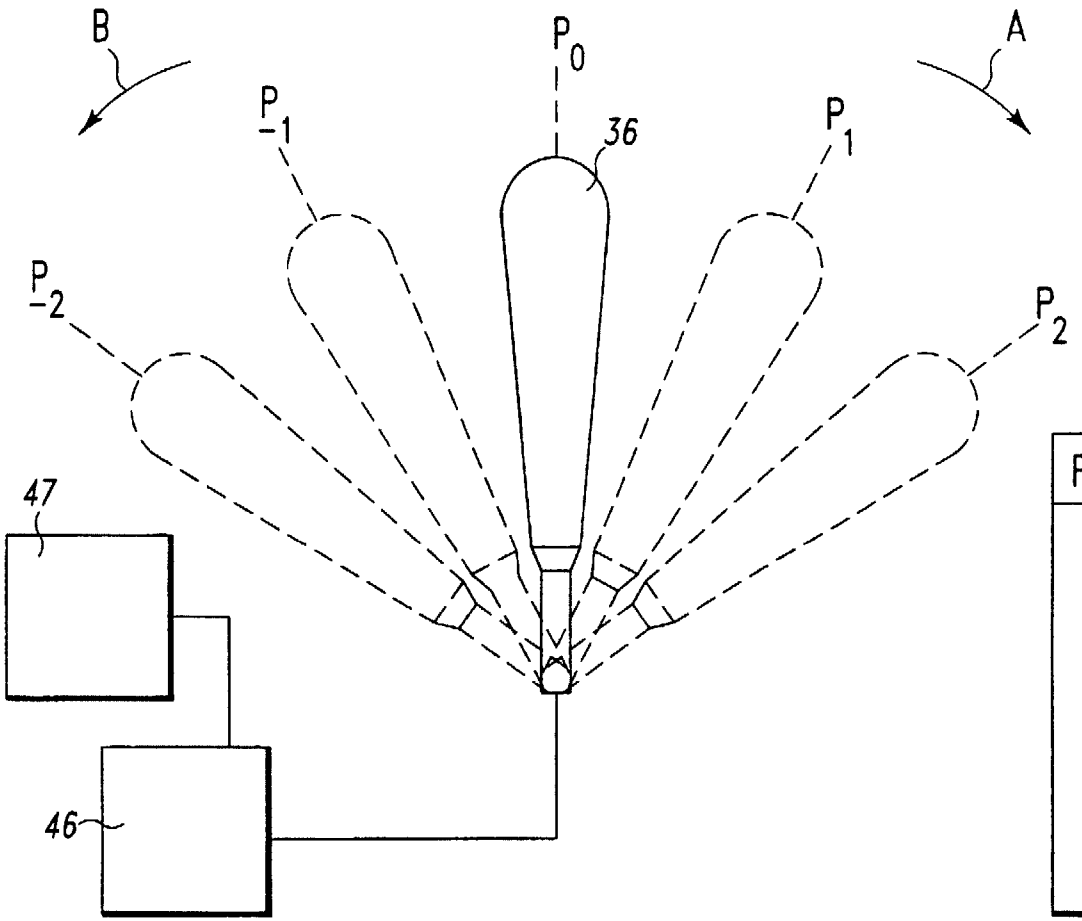
FIG. 3A is a side elevational view of a lever of the implement control device of FIG. 2 showing a number of control positions in phantom with a potentiometer shown schematically coupled to the lever.
FIG. 3B is a table showing the relationship between three variables: (1) Position of the lever of FIG. 3A, (2) Speed of a broom of the vehicle of FIG. 1, and (3) Rotational direction of the broom of the vehicle of FIG. 1.

The broom lever 36 is operatively linked to a potentiometer 46 (see FIG. 3A). In particular, movement of the broom lever 36 causes an output signal on the potentiometer 46 to be varied.

Referring now to FIGS. 3A and 3B, the broom lever 36 is shown schematically coupled to the potentiometer 46. The potentiometer is in turn operatively coupled to the hydraulic motor 47 which turns or rotates the broom 16 about the axle 26 thereby creating a sweeping motion. As seen in FIG. 3A, the broom lever 36 has a neutral control position $P_0$ and a number of actuated control positions $P_{-2}$, $P_{-1}$, $P_1$, and $P_2$. As the broom lever 36 is moved by the operator in the general direction of arrow A, the output signal from the potentiometer 46 is varied such that the broom 16 is rotated about the axle 26 at various speeds in a clockwise direction. In particular, at control position $P_1$ the broom 16 is caused to rotate in the clockwise direction at a speed of x revolutions per minute (RPM), whereas further movement of the broom lever 36 in the general direction of arrow A causes the broom lever 36 to be positioned in the control position $P_2$ wherein the broom 16 is caused to rotate in the clockwise direction at a speed of 2X RPM.

Similarly, as the broom lever 36 is moved by the operator in the general direction of arrow B, the output signal from the potentiometer 46 is varied such that the broom 16 is rotated about the axle 26 at various speeds in a counterclockwise direction. In particular, at control position $P_{-1}$ the broom 16 is caused to rotate in the counterclockwise direction at a speed of X RPM, whereas further movement of the broom lever 36 in the general direction of arrow B causes the broom lever 36 to be positioned in the control position $P_{-2}$ wherein the broom 16 is caused to rotate in the counterclockwise direction at a speed of 2X RPM.

It should be appreciated that although four actuated control positions $P_{-2}$, $P_{-1}$, $P_0$, $P_1$, and $P_2$ are shown in FIGS. 3A and 3B, a given broom lever 36 may have any number of actuated control positions thereby causing any number of different output signals to be created by the potentiometer 46. Similarly, although two speeds X and 2X are shown in FIG. 3B, any number of different speeds may be created by the output signal of the potentiometer 46.

Referring back to FIG. 2, the slave member 38 is coupled to the broom lever 36 by a pair of bolts 48. Hence, movement of the broom lever 36 causes movement of the slave member 38. Moreover, the slave member 38 has a number of notches 50 defined therein. The retainer assembly 40 cooperates with the notches 50 such that the broom lever 36 may be retained in a given control position (e.g. the control positions $P_{-2}$, $P_{-1}$, $P_0$, $P_1$, and $P_2$ of FIG. 3A).

The disengagement lever 42 is mechanically coupled to the disengagement linkage 44. In turn, the disengagement linkage 44 is mechanically coupled to the retainer assembly 40. The position of the disengagement lever 42, and hence the disengagement linkage 44, selectively allows the retainer assembly 40 to be engaged with or disengaged from the notches 50.

Figure 4:
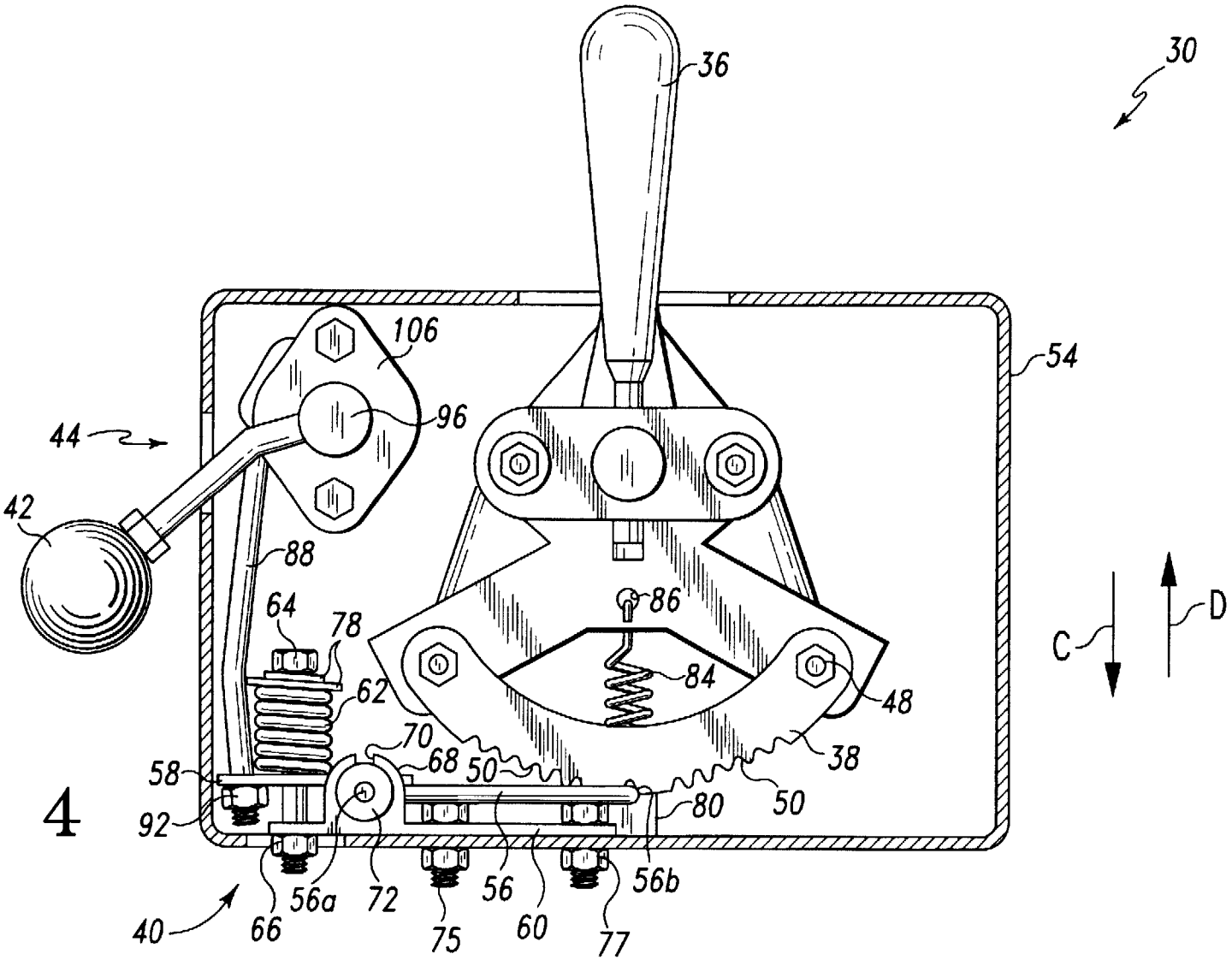
FIG. 4 is a front elevational view of the implement control device of FIG. 2.
Figure 5:
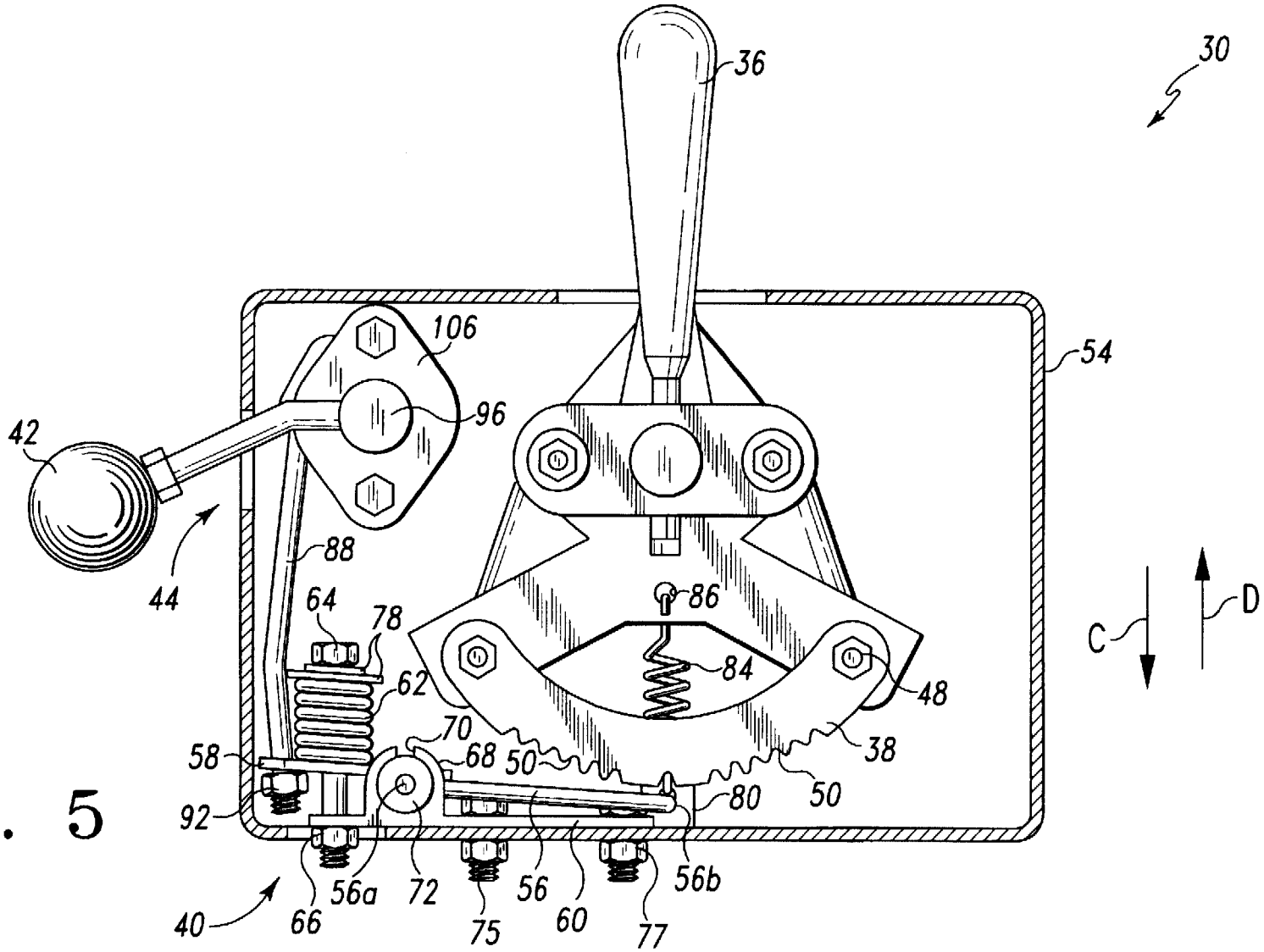
FIG. 5 is a view similar to FIG. 4, but showing a retainer of the implement control device located in a second retainer position.
Figure 6:
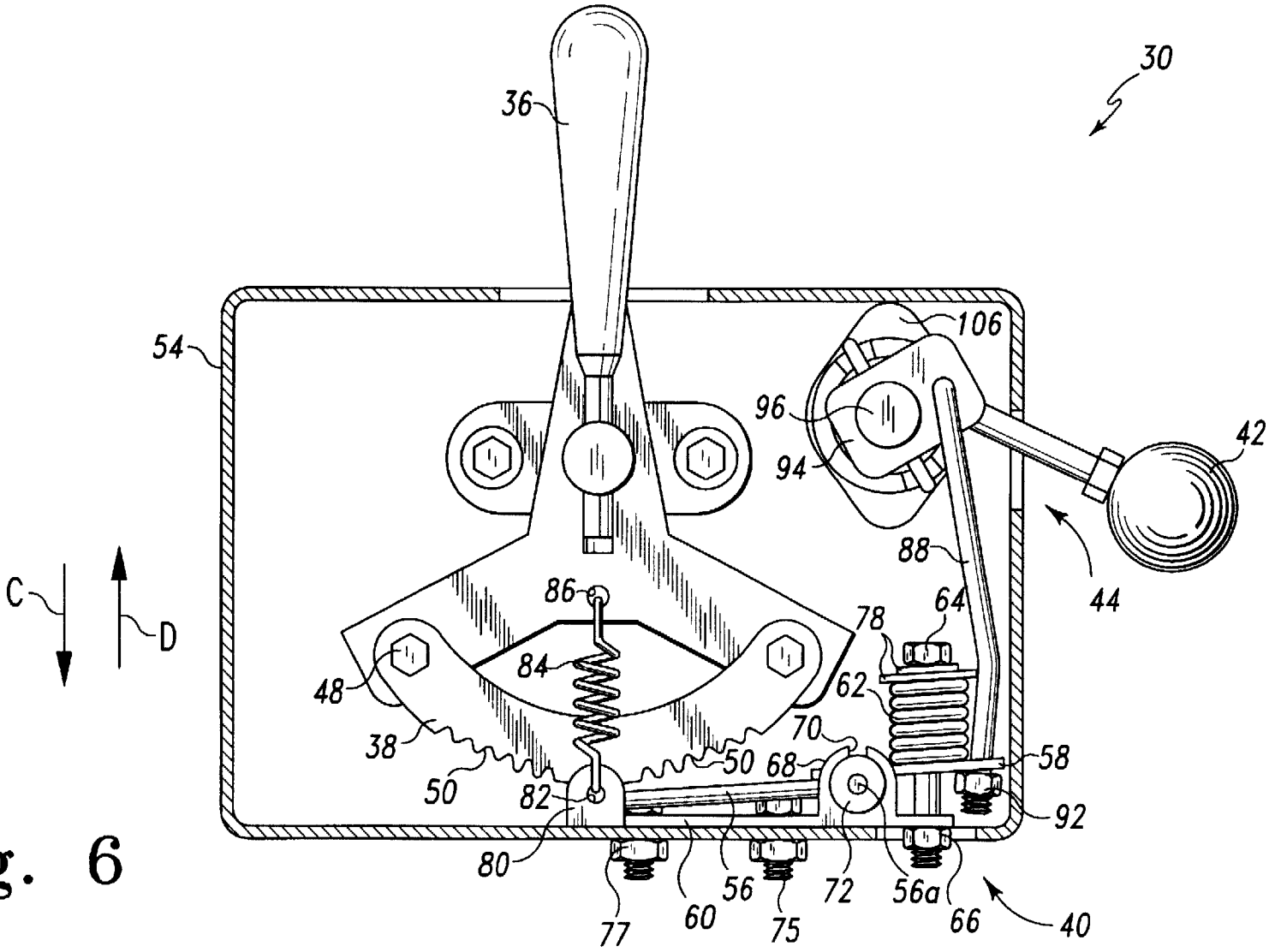
FIG. 6 is a rear elevational view of the implement control device of FIG. 2.

Referring now to FIGS. 4–6, there is shown the implement control device 30. The implement control device includes a housing 54, a portion of which has been removed for clarity of description.

The retainer assembly 40 includes a U-shaped retainer 56, a biasing plate 58, a base 60, and a retainer spring 62. The biasing plate 58 is welded, or similarly fastened, to the retainer 56.

Figure 7:
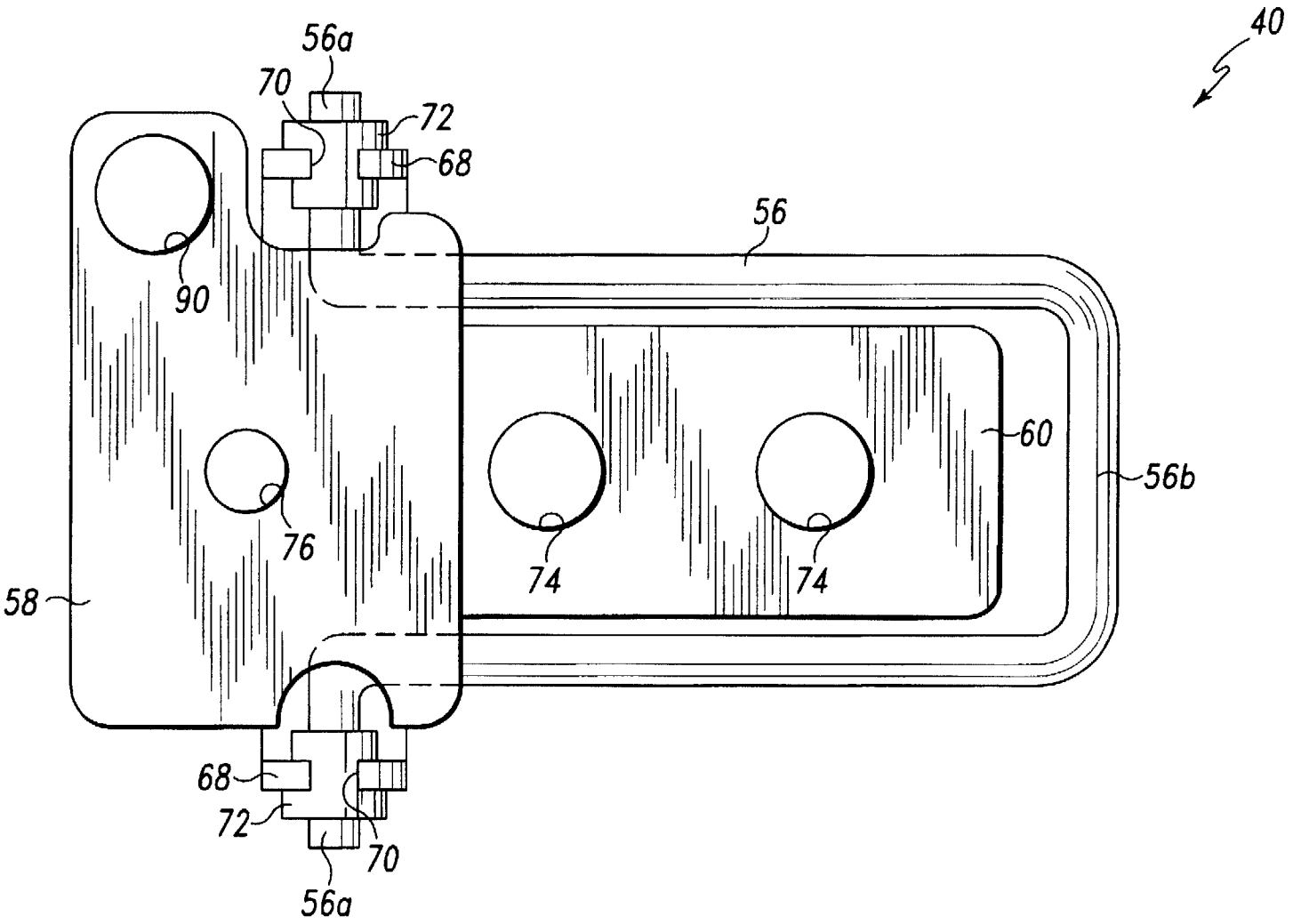
FIG. 7 is a top elevational view of a retainer assembly of the implement control device of FIG. 2.

The retainer assembly 40 is shown in more detail in FIG. 7. Note that the retainer spring 62 has been removed for clarity of description. The base 60 includes a pair of brace members 68, each having a slot 70 defined therein. A pair of outwardly extended portions **56*a* of the retainer 56 is received into the slots 70. Each of the outwardly extended portions 56a are secured in the slots 70 by a friction-fitted fastener 72. Hence, the retainer 56 is pivotally attached to the base 60**.

The base 60 includes a pair of holes 74 defined therein. The holes 74 receive a pair of bolts 75 (see FIG. 4). The bolts 74 are threadingly engaged by nuts 77 such that the retainer assembly 40 is fastened to the housing 54 (see FIG. 4).

Referring back to FIGS. 4–6, the retainer spring 62 biases the retainer 56 into contact with one of the notches 50. More specifically, a bolt 64 is received through a number of washers 78, the retainer spring 62, a hole 76 (see FIG. 7) defined in the biasing plate 58, a hole (not shown) defined in the base 60. In addition, a lower end of the bolt 64 is threadingly engaged by a nut 66. Hence, the retainer spring 62 is sandwiched between the washers 78 and the biasing plate 58 thereby urging the biasing plate 58 in the general direction of an arrow C.

As the biasing plate is urged in the general direction of the arrow C, the retainer 56 is pivoted about the base 60 such that an engagement portion 56b of the retainer 56 is moved in the general direction of arrow D and received into one of the notches 50 of the slave member 38. Hence, the biasing force generated by the retainer spring 62 positions the retainer 56 into a first or engaged retainer position wherein the engagement portion 56b of the retainer 56 is received into a notch 50, as shown in FIG. 4.

The housing 54 includes a tab 80 with a hole 82 defined therein. A first end of a centering spring 84 is received into the hole 82, whereas a second end of the centering spring 84 is received into a hole 86 defined in the broom lever 36. When the retainer 56 is positioned in a second or disengaged position wherein the engagement portion 56b is spaced apart from the notches 50, as shown in FIGS. 5 and 6, the centering spring 84 positions the broom lever 36 in the neutral position P, (see FIG. 3A) unless the operator of the vehicle 10 is holding or otherwise applying force to the broom lever 36.

The retainer spring 62 generates a biasing force which is greater than the force generated by the centering spring 84. In particular, the magnitude of the biasing force exerted by retainer spring 62 onto the biasing plate 58 retains the engagement portion 56b of the retainer 56 into one of the notches 50, thereby preventing the force generated by the centering spring 84 to return the broom lever 36 to the neutral position $P_0$.

However, the magnitude of the biasing force generated by the retainer spring 62 is not large enough so as to prevent the operator of the vehicle 10 from manually moving the broom lever 36 from one position (e.g. $P_2$) to another position (e.g. $P_0$). In particular, the magnitude of the biasing force exerted by retainer spring 62 onto the biasing plate 58, and hence onto the notches 50 by the retainer 56, allows the operator to push or pull on the broom lever 36 so as to remove the engagement portion 56b of the retainer 56 from one of the notches 50 and thereafter reposition the engagement portion 56b into a different notch 50.

It should be appreciated that the magnitude of the biasing force exerted on the biasing plate 58 by the retainer spring 62 may be altered by tightening or loosening the nut 66. More specifically, if the nut 66 is tightened (i.e. the distance between the nut 66 and the washers 78 is decreased) the biasing force exerted on the biasing plate 58 by the retainer spring 62 is increased. Alternatively, if the nut 66 is loosened (i.e. the distance between the nut 66 and the washers 78 is increased) the biasing force exerted on the biasing plate 58 by the retainer spring 62 is decreased.

The disengagement lever 42 may be used to "lock" or otherwise position the retainer 56 into the second or disengaged retainer position, as shown in FIGS. 5 and 6. In particular, the disengagement linkage 44 prevents the engagement portion 56b from engaging the notches 50.

Figure 8:
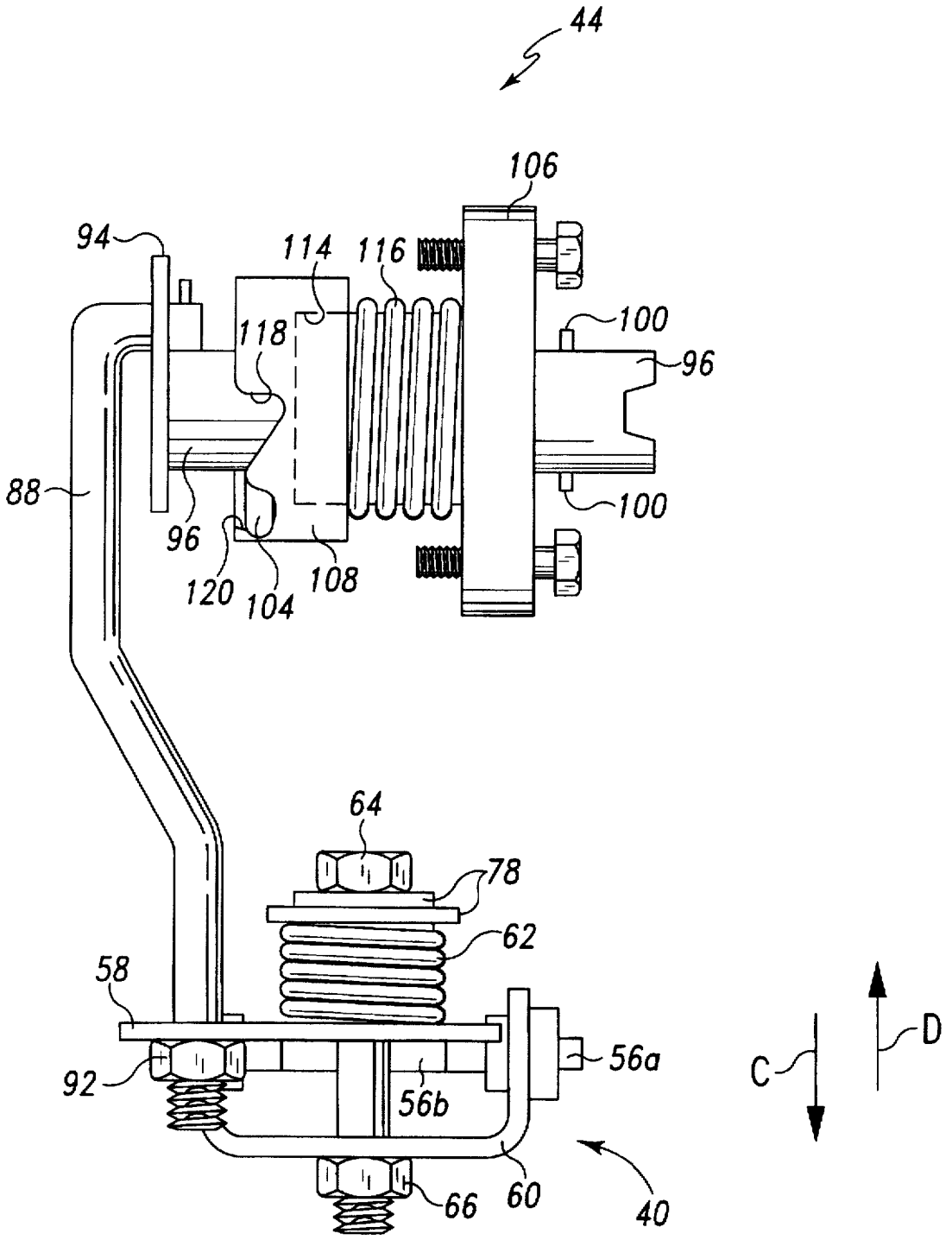
FIG. 8 is a side elevational view of a mechanical disengagement linkage of the implement control device of FIG. 2.

The disengagement linkage 44 includes a rod 88, a rod position plate 94, a shaft 96, a locking pin 104 (see FIG. 8), a lever plate 106 (see FIG. 8), a locking member 108 (see FIG. 8), and a locking spring 116 (see FIG. 8). The rod 88 is received at a first end through a hole 90 defined in the biasing plate 58 (see FIG. 7) and threadingly engaged by a blocking member or nut 92. At a second end, the rod 88 is coupled to a first end of the rod position plate 94 (see FIG. 6). A second end of the rod position plate 94 is fixedly (i.e. non-rotatably) coupled to a first end of the shaft 96. A second end of the shaft 96 is coupled to the disengagement lever 42. Hence, if the disengagement lever 42 is moved in the general direction of arrow C, the rod 88 will likewise be moved in the general direction of arrow C. Similarly, if the disengagement lever 42 is moved in the general direction of arrow D, the rod 88 will likewise be moved in the general direction of arrow D.

Figure 9:
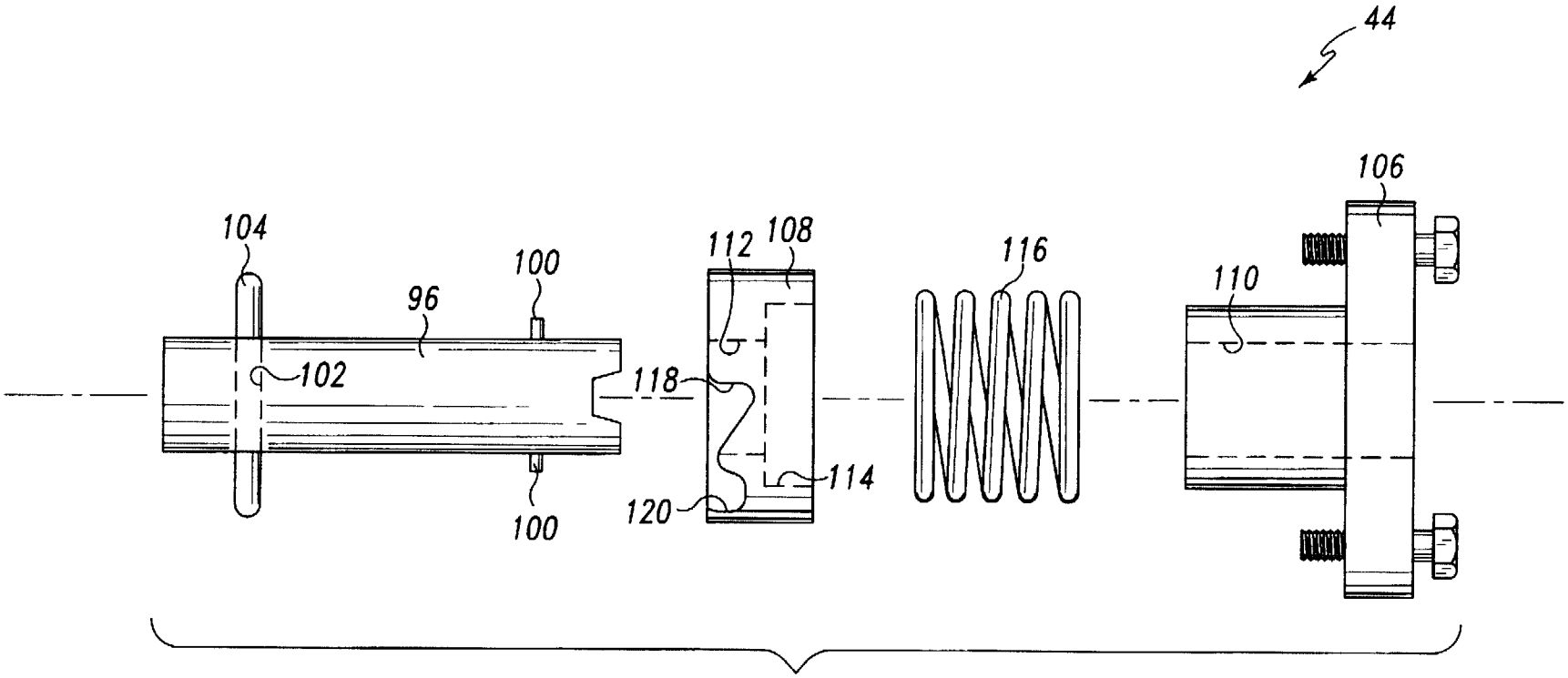
FIG. 9 is an exploded side elevational view of a portion of the disengagement linkage of FIG. 8.

Referring now to FIGS. 8 and 9, there is shown the relationship between the disengagement linkage 44 and the retainer assembly 40. Note that the disengagement lever 42 has been removed from the second end of the shaft 96 for clarity of description. The second end of the shaft 96 includes a number of fastening pins 100 to which the disengagement lever 42 is coupled. Hence, the disengagement lever 42 is non-rotatably affixed to the shaft 96.

The shaft 96 further includes an aperture 102 extending radially therethrough. The locking pin 104 is positioned within and protrudes from both ends of the aperture 102.

The lever plate 106 and the locking member 108 include openings 110 and 112, respectively, defined therein. The shaft 96 is received through the openings 110 and 112. Hence, the lever plate 106 and the locking member 108 are rotatably coupled to the shaft 96. In addition, a first portion of the lever plate 106 is received into an opening 114 of the locking member 108 as shown in FIG. 8. The lever plate 106 and the locking member 108 do not rotate relative one another.

Disposed between the lever plate 106 and the locking member 108 is the locking spring 116. The locking spring 116 urges the locking member 108 into contact with the locking pin 104. More specifically, the locking spring 116 urges the locking member 108 against the locking pin 104 such that the locking pin 104 is received into either a first locking notch 118 or a second locking notch 120. When the locking pin 104 is received into the locking notches 118 or 120, the shaft 96 is inhibited from rotating relative the locking member 108. Hence, the rod 88 is prevented from moving in the general direction of either the arrow C or the arrow D.

If the disengagement lever 42 is moved by the operator of the vehicle 10 in the general direction of the arrow D, the disengagement linkage 44 is positioned in a first position configuration. When the disengagement linkage 44 is positioned in the first position configuration as shown in FIG. 5, the rod 88, the rod position plate 94, the shaft 96, the locking pin 104, the lever plate 106, the locking member 108, and the locking spring 116 each are in a first respective position. For example, the rod 88 is moved in the general direction of arrow D and positioned in a raised position. When the rod 88 is moved to this raised position, the nut 92 is moved to a raised or blocking position, thereby urging the biasing plate 58 in the general direction of arrow D, which in turn positions the retainer 56 in the second or disengaged position, i.e. spaced apart from the notches 50, as shown in FIG. 5. Therefore, if an operator does not move, hold, or otherwise apply force to the broom lever 36, the centering spring 84 (see FIG. 6) will return the broom lever 36 to the neutral position $P_0$ (see FIG. 3A).

Similarly, if the disengagement lever 42 is moved in the general direction of the arrow C, the disengagement linkage 44 is positioned in a second position configuration. When the disengagement linkage 44 is positioned in the second position configuration as shown in FIG. 4, the rod 88, the rod position plate 94, the shaft 96, the locking pin 104, the lever plate 106, the locking member 108, and the locking spring 116 each are in a second respective position. For example, the rod 88 is moved in the general direction of arrow C and positioned in a lowered position. When the rod 88 is moved to this lowered position, the nut 92 is moved to a lowered or non-blocking position, thereby allowing the retainer spring 62 to exert a biasing force on the biasing plate 58, which in turn positions the retainer 56 in the first or engaged position, i.e. in contact with the notches 50, as shown in FIG. 4. Therefore, an operator may move the broom lever 36 to a desired position (e.g. the control positions $P_{-2}$, $P_{-1}$, $P_1$, and $P_2$ of FIG. 3A) wherein the broom lever 36 will be retained by the retainer 56 until the operator either (1) readjusts the broom lever 36 or (2) moves the disengagement lever 42 in the general direction of the arrow D as described above.

As described, the implement control device 30 allows a lever to be retained in a desired position without the need for an operator to manually retain the lever. Moreover, the implement control device 30 allows a lever to be retained in a desired position without the need for a separate retaining device, such as a strap.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

It should be understood that the broom lever 36 may be used to control an implement other than the broom 16. For example, the broom lever 36 may be used to control a hydraulic motor which operates a grapple on a wheel loader for a logging operation.

What is claimed is:

1. A position setting apparatus, comprising:

a control member;

a slave member mechanically coupled to said control member, said slave member having a plurality of notches defined therein;

a retainer positionable between a first retainer position and a second retainer position, wherein (i) said retainer is engaged with one of said plurality of notches when said retainer is positioned in said first retainer position, and (ii) said retainer is disengaged from all of said plurality of notches when said retainer is positioned in said second retainer position;

a first spring which generates a biasing force which is transmitted to said retainer; and a blocking member positionable between a blocking position and a non-blocking position, wherein (i) said blocking member is positioned within a path of movement of said retainer when said blocking member is positioned in said blocking position, and (ii) said blocking member is spaced apart from said path of movement of said retainer when said blocking member is positioned in said non-blocking position.

2. The apparatus of claim 1, wherein:

said control member is movable between a first control position and a second control position, an implement is moved at a first speed when said control member is positioned at said first control position, and said implement is moved at a second speed when said control member is positioned at said second control position.

3. The apparatus of claim 2, wherein:

said control member is coupled to a potentiometer, an output signal line of said potentiometer is connected to a motor operatively coupled to said implement, said potentiometer causes said output signal line to possess a first signal value when said control member is positioned at said first control position, and said potentiometer causes said output signal line to possess a second signal value when said control member is positioned at said second control position.

4. The apparatus of claim 1, further comprising:

a mechanical linkage secured to said blocking member, wherein (i) said mechanical linkage is positionable at a first position configuration and a second position configuration, (ii) said mechanical linkage positions said blocking member in said blocking position when said mechanical linkage is positioned in said first position configuration, and (iii) said mechanical linkage positions said blocking member in said non-blocking position when said mechanical linkage is positioned in said second position configuration.

5. The apparatus of claim 4, wherein:

said blocking member is a nut, and said mechanical linkage includes a rod having said nut secured to a first end portion thereof.

6. The apparatus of claim 5, wherein said mechanical linkage further includes:

a first plate secured to a second end portion of said rod, a shaft secured to said first plate, said shaft having an aperture extending radially therethrough, a second plate having a first opening defined therein, said shaft being received within said first opening, a locking member having a second opening defined therein, said shaft being received within said second opening, and a pin positioned within said aperture of said shaft.

7. The apparatus of claim 6, wherein said locking member is interposed between said first plate and said second plate.

8. The apparatus of claim 7, further comprising a second spring positioned around said shaft and interposed between said second plate and said locking member.

9. The apparatus of claim 8, wherein:

said locking member has a first locking notch and a second locking notch defined therein, said second spring urges said locking member against said pin, and said pin is received in either said first locking notch or said second locking notch when said locking member is urged against said pin.

10. The apparatus of claim 9, further comprising a lever which is secured to said second plate.

11. An apparatus which controls speed of an implement, comprising:

a first lever movable between a first control position and a second control position;

a slave member mechanically coupled to said first lever, said slave member having a plurality of notches defined therein;

a retainer positionable between a first retainer position and a second retainer position, wherein (i) said retainer is engaged with one of said plurality of notches when said retainer is positioned in said first retainer position, and (ii) said retainer is disengaged from all of said plurality of notches when said retainer is positioned in said second retainer position;

wherein (i) said implement is moved at a first speed when said first lever is positioned at said first control position, and (ii) said implement is moved at a second speed when said first lever is positioned at said second control position, and further comprising:

a first spring which generates a biasing force which is transmitted to said retainer; and a nut positionable between a blocking position and a non-blocking position, wherein (i) said nut is positioned within a path of movement of said retainer when said nut is positioned in said blocking position, and (ii) said nut is spaced apart from said path of movement of said retainer when said nut is positioned in said non-blocking position.

12. The apparatus of claim 11, further comprising:

a mechanical linkage secured to said nut, wherein (i) said mechanical linkage is positionable at a first position configuration and a second position configuration, (ii) said mechanical linkage positions said nut in said blocking position when said mechanical linkage is positioned in said first position configuration, and (iii) said mechanical linkage positions said nut in said non-blocking position when said mechanical linkage is positioned in said second position configuration.

13. The apparatus of claim 12, wherein said mechanical linkage includes:

a rod having said nut secured to a first end portion thereof, a first plate secured to a second end portion of said rod, a shaft secured to said first plate, said shaft having an aperture extending radially therethrough, a second plate having a first opening defined therein, said shaft being received within said first opening, a locking member having a second opening defined therein, said shaft being received within said second opening, and a pin positioned within said aperture of said shaft.

14. The apparatus of claim 13, further comprising a second spring positioned around said shaft and interposed between said second plate and said locking member.

15. The apparatus of claim 14, wherein:

said locking member has a first locking notch and a second locking notch, said second spring urges said locking member against said pin, and said pin is received in either said first locking notch or said second locking notch when said locking member is urged against said pin.

16. The apparatus of claim 15, further comprising a second lever which is secured to said second plate.

17. The apparatus of claim 16, wherein:

said first lever is coupled to a potentiometer, an output signal line of said potentiometer is connected to a motor operatively coupled to said implement, said potentiometer causes said output signal line to possess a first signal value when said first lever is positioned at said first control position, and said potentiometer causes said output signal line to possess a second signal value when said first lever is positioned at said second control position.

* * * * *